US006761284B2

(12) United States Patent
Knepler

(10) Patent No.: US 6,761,284 B2
(45) Date of Patent: Jul. 13, 2004

(54) MATERIAL DETECTION SYSTEM FOR A BEVERAGE DISPENSER

(75) Inventor: John T. Knepler, Springfield, IL (US)

(73) Assignee: Bunn-O-Matic Corporation, Springfield, IL (US)

( * ) Notice: Subject to any disclaimer, the term of this patent is extended or adjusted under 35 U.S.C. 154(b) by 0 days.

(21) Appl. No.: 10/382,049

(22) Filed: Mar. 5, 2003

(65) Prior Publication Data

US 2004/0011807 A1 Jan. 22, 2004

Related U.S. Application Data

(60) Provisional application No. 60/396,172, filed on Jul. 16, 2002.

(51) Int. Cl.[7] ..... B67D 5/08
(52) U.S. Cl. ..... 222/64; 222/129.4
(58) Field of Search ..... 222/64, 66, 129.4, 222/145.5, 56, 67

(56) References Cited

U.S. PATENT DOCUMENTS 4,160,168 A * 7/1979 Funck ..... 250/564
4,247,784 A * 1/1981 Henry ..... 250/577
4,354,180 A * 10/1982 Harding ..... 340/619
4,493,249 A 1/1985 Stover
4,524,282 A * 6/1985 King ..... 250/577
4,579,253 A * 4/1986 Shenier ..... 222/56
4,848,149 A * 7/1989 Fiorentino et al. ..... 73/293
5,002,102 A * 3/1991 Hosel ..... 141/94
5,216,469 A * 6/1993 Yamada ..... 399/59
5,918,768 A 7/1999 Ford
5,927,553 A 7/1999 Ford
6,349,852 B1 2/2002 Ford
6,419,120 B1 * 7/2002 Bertone ..... 222/129.4

FOREIGN PATENT DOCUMENTS

JP 2000329607 A * 5/1999 ..... G01F/23/28

* cited by examiner

*Primary Examiner*—Gene Mancene
*Assistant Examiner*—Melvin A Cartagena
(74) *Attorney, Agent, or Firm*—Barnes & Thornburg LLP

(57) ABSTRACT

A system, method and apparatus for detecting the presence or absence as well as the level of material in a beverage dispenser. The system includes a sensor assembly including a light source and a light detector. The source and detector are in close proximity to one another with the detector detecting a beam emitted from the source and the beam is reflected from material retained in the container. A controller is provided and receives a signal from the sensor assembly for controllably operating functions of the beverage dispenser based on the detection signal from the sensor assembly relating to material in the container. The apparatus for detecting a level of material in the container includes a comparator coupled to the sensor assembly for receiving a signal from the detector, the output from the comparator coupled to the controller. A variable gain amplifier is coupled to the detector for receiving an output signal from the detector. The variable gain amplifier provides an input signal to the comparator. The method of operation of the system and apparatus compensates for tolerances and environmental variables.

28 Claims, 6 Drawing Sheets

MATERIAL DETECTION SYSTEM FOR A BEVERAGE DISPENSER

CROSS-REFERENCE TO RELATED APPLICATIONS

This application claims the benefit of U.S. Provisional Application No. 60/396,172, filed Jul. 16, 2002, assigned to the assignee of the present application, Bunn-O-Matic Corporation.

BACKGROUND

This disclosure relates generally to a beverage dispenser, and more particularly to an apparatus, system and method relating to detecting the level of material in a beverage dispenser material container.

The detection of the level of material/concentrate in the container, also referred to as a hopper, of a beverage dispenser is important for a number of reasons. Such a hopper may be used, for example, in a powdered beverage dispenser which dispenses a quantity of powdered beverage concentrate from the hopper to be mixed with water to produce a beverage. An indication of a low level of material in the hopper warns the operator that more material needs to be added in the near future. While an empty indication tells the operator to add material now. Also, informing the operator of the level of material in the hopper reduces the potential for producing inferior quality beverages because not enough of the material was used in making the beverage.

The use of an optical sensor for detecting the level of material in a hopper is known in the prior art. For example, the assignee of this application currently use an optical sensor to detect the level of powder in a beverage hopper. However, the current sensor technology uses what is referred to as a through-beam system. The through-beam configuration transmits a beam from one side of the hopper, through the hopper and receives the beam on the opposite side of the hopper. The through-beam configuration does not work in some situations, such as, for example, with a multiple hopper machine because the hoppers are parallel and aligned next to one another providing virtually no room for transmitter and receiver devices next to and between the hoppers.

The present disclosure relates to a method and apparatus for sensing the status of material/concentrate in the hopper of a beverage dispenser. The present disclosure employs an optical sensor assembly to detect the presence or absence of material in the hopper. The hopper is a generally transparent structure so that light emitted by the sensor assembly can pass through the wall and be received by a second portion of the sensor assembly. The sensor assembly is positionable at a desired level of the hopper so that a low or empty condition is sensed. In the low condition the sensor is positioned above the base of the hopper so that some amount of beverage powder remains in the hopper when a low condition is indicated. Alternatively, the sensor assembly can be positioned at the lowest level whereby the beverage dispenser still operates in the desired manner until the lowest level of material is achieved.

The sensor assembly operates as a reflected signal infrared sensor allowing the sensor assembly to be positioned at the rear of the hopper. With the sensor assembly positioned at the rear of the hopper, multiple sensor assemblies can be used in a multiple hopper machine to sense the material level in each of the corresponding hoppers.

The present disclosure provides a hopper level sensor assembly for a beverage dispenser. One embodiment of the beverage dispenser according to the present disclosure includes a container or hopper, a sensor assembly, and a controller. The sensor assembly detects the presence or absence, or both, of material in the hopper. The controller controls the function of the beverage dispenser depending on the output of the sensor assembly. If the sensor assembly senses material in the hopper, the controller allows the beverage dispenser to operate normally. If the sensor does not sense material in the hopper, the controller restricts or ceases the operation of the beverage dispenser.

Additional features will become apparent to those skilled in the art upon consideration of the following detailed description of drawings exemplifying the best mode as presently perceived.

BRIEF DESCRIPTION OF THE DRAWINGS

The present disclosure will be described hereafter with reference to the attached drawings which are given as a non-limiting example only, in which.

Figure 1:
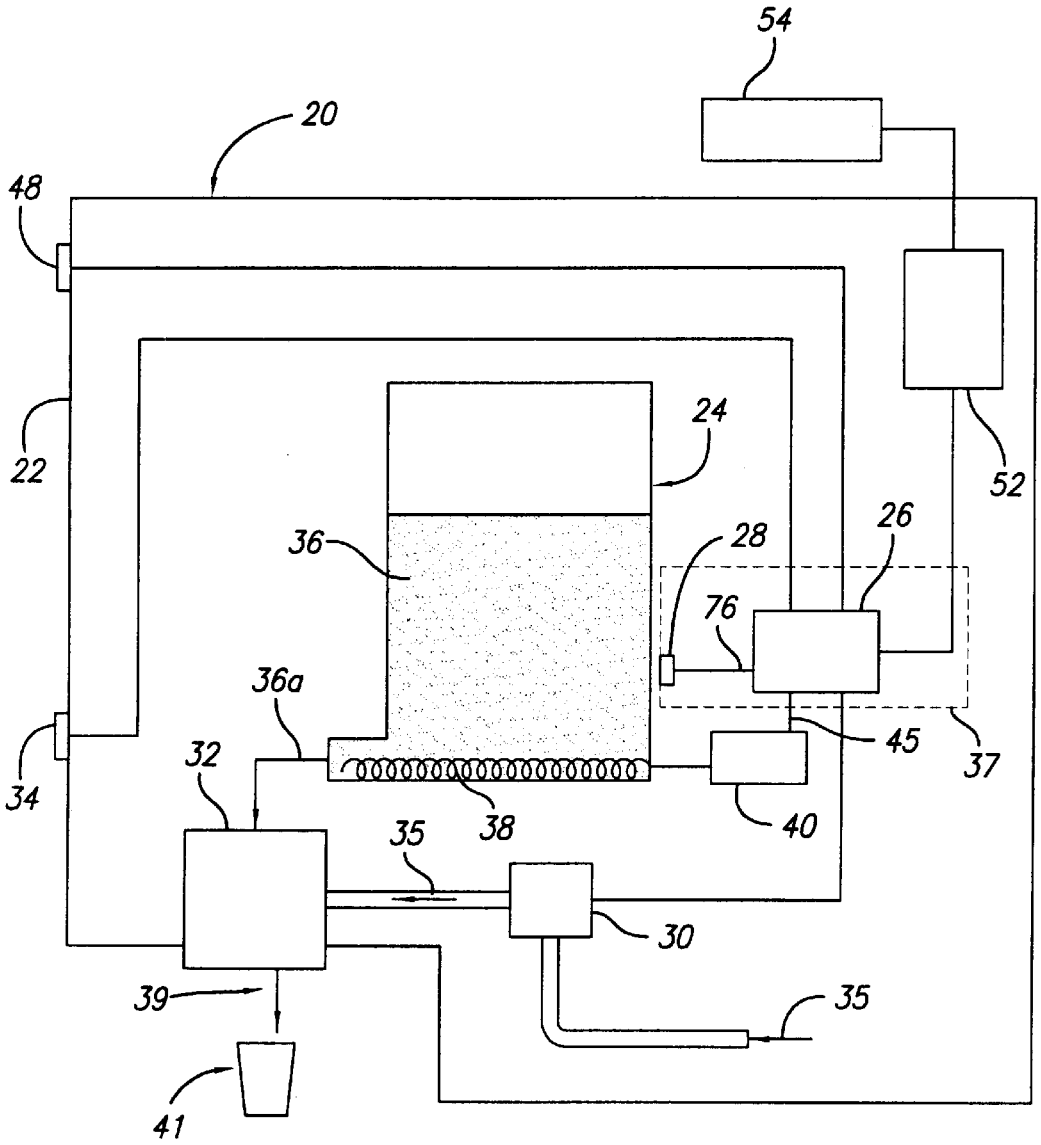
FIG. 1 is a diagrammatic side view of a beverage dispenser according to the present disclosure.

The exemplification set out herein illustrates embodiments of the disclosure that is not to be construed as limiting the scope of the disclosure in any manner.

DETAILED DESCRIPTION

While the present disclosure may be susceptible to embodiment in different forms, there is shown in the drawings, and herein will be described in detail, embodiments with the understanding that the present description is to be considered an exemplification of the principles of the disclosure and is not intended to be exhaustive or to limit the disclosure to the details of construction and the arrangements of components set forth in the following description or illustrated in the drawings.

The present disclosure provides an apparatus, system and method including a hopper level sensor assembly for use with or in combination with a beverage dispenser. Referring to FIG. 1, one embodiment of a beverage dispenser 20 according to the present disclosure includes a housing 22 which contains a container or hopper 24, a controller 26, a sensor assembly 28, a solenoid valve 30, mixing assembly or apparatus 32, and switch 34. The sensor assembly 28 and controller 26 define an apparatus 37 for detecting a level of material in a beverage dispenser 20.

Hopper 24 is made from a material 25 which is generally at least partially transparent to light, allowing some degree of light to pass therethrough, and contains a powder or concentrate 36. Such a hopper material might include plastics, glass or other form of semi-transparent material which might suitably perform the desired characteristics of a hopper. Additionally, for example, it is envisioned that a frame structure may be provided in which to retain some form of at least partially transparent bag material that will allow replacement of the hopper yet permitting use of the disclosed system, method and apparatus for detecting the level of material in a beverage dispenser.

Terms including beverage, brewed, brewing, brewing substance, brewed liquid, and brewed beverage as may be used herein are intended to be broadly defined as including, but not limited to, the brewing of coffee, tea and any other beverages. This broad interpretation is also intended to include, but is not limited to any process of dispensing, infusing, steeping, reconstituting, diluting, dissolving, saturating or passing a liquid through or otherwise mixing or combining a beverage substance with a liquid such as water without limitation to the temperature of such liquid unless specified. This broad interpretation is also intended to including, but is not limited to beverage substances such as ground coffee, tea, liquid beverage concentrate, powdered beverage concentrate, flaked, granular, freeze dried or other forms of materials including liquid, gel, crystal or other forms of beverage or food materials to obtain a desired beverage or other food product.

An example of a type of beverage dispenser 20 in which the apparatus, system and method might be used is shown in U.S. Pat. No. 5,927,553 issued Jul. 27, 1999 to the assignee of the present application which is incorporated herein by reference. This patent shows a powdered dispenser in which powdered beverage material is retained in a series of containers or hoppers under controlled dispensing by use of a rotary auger system positioned in the hopper. Such material which might be stored in the hoppers for controlled dispensing include coffees, cappuccino-style beverages, cocoa and other such beverages, for example in a powdered form.

One of the benefits of the disclosed system, method and apparatus is that is reliably senses the presence or absence of the material in the hopper. Additionally, since there is a wide range of physical characteristics of the powder or other material such as powdered, flaked, granular, freeze dried or other forms of materials including liquid, gel, crystal or other forms of beverage or food materials, the disclosed system, method and apparatus accommodates this wide range of physical characteristics and reliably detects the level of material, or absence thereof, in the hopper. As will be described in greater detail herein below, a disclosed embodiment of the system, method and apparatus provides feedback from the controller to compensate for tolerances and environmental variables which might otherwise prevent other systems from operating properly.

In general, the system operates when switch 34 is activated to initiate a dispensing cycle in which water 35 controllably passing through solenoid valve 30 is mixed with beverage powder or concentrate 36 in mixing assembly 32. The dispenser 20 dispenses a beverage 39 to a corresponding cup or container 41. When powdered concentrate is used, an auger 38 is operated by a motor 40 in response to a signal from controller 26 to rotate for a given period of time or number of rotations to dispense a proportional amount of powder into mixing assembly 32. Controller 26 also operates solenoid valve 30 associated with a water distribution system to combine powder 36 and water in mixing assembly 32 and dispense a resultant beverage therefrom. Sensor assembly 28 is coupled to controller 26 for detecting the level of powder 36 in hopper 24. It is envisioned that the disclosed apparatus, system and method of level detection will also operate with other embodiments of powder dispensers.

The beverage dispenser 20 includes apparatus for detecting the level of material 36 in a container 24 associated with the beverage dispenser 20. Dispenser assembly 38 is connected to the controller 26 to control operation of the beverage dispenser 20 in relation to the material 36 retained in the container 24. The container 24 retains a volume of material 36. The mixing apparatus 32 combines the material 36*a* dispensed from the hopper 24 with water 35 which has been allowed to pass through the valve 30 under control of the controller 26 over line 43. The controller 26 is controllably connected to the mixing apparatus by means of the line 43 connected to the controllable valve 30 and line 45 connected to the controllable motor 40 which operates the auger 38. The mixing apparatus might also include other devices for agitating or otherwise mechanically combining the water 35 and the material 36*a* dispensed from the hopper 24.

Figure 2:
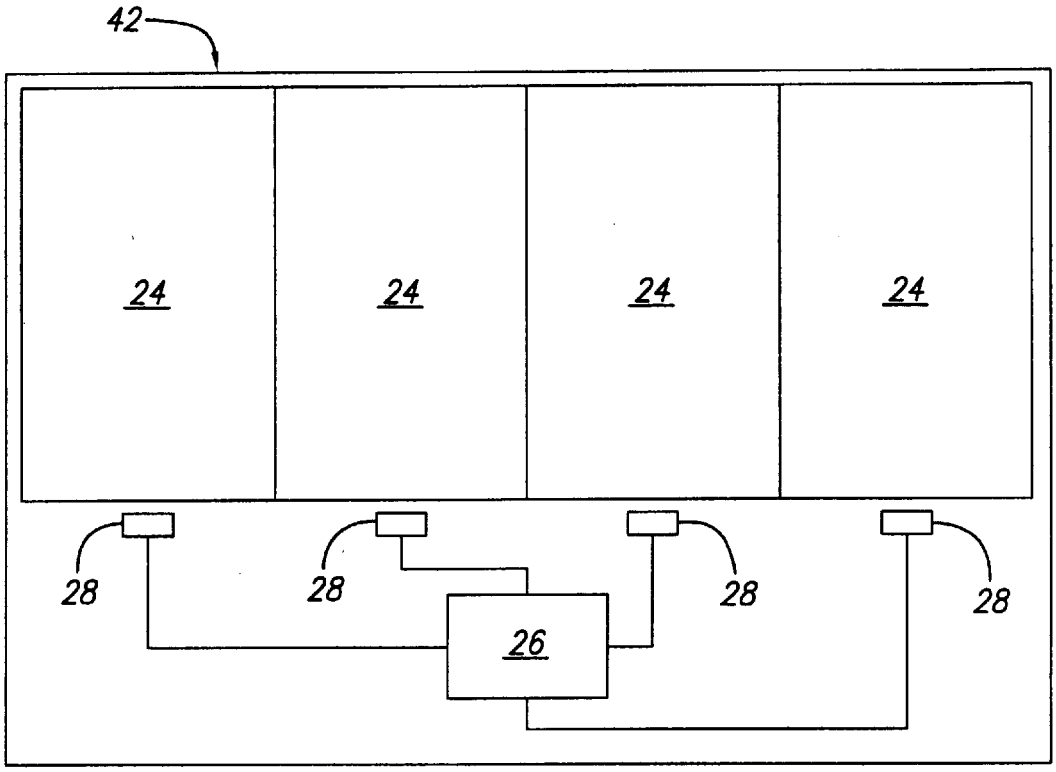
FIG. 2 is a diagrammatic top plan view of a beverage dispenser having multiple dispensing units.

FIG. 2 shows a multiple hopper beverage dispenser in accordance with the present disclosure. Using sensor assemblies 28 positioned at the rear of each hopper 24, a series of hoppers 24 can be positioned within a single housing 42 allowing close side by side orientation of multiple hoppers 24 within housing 42.

Figure 3:
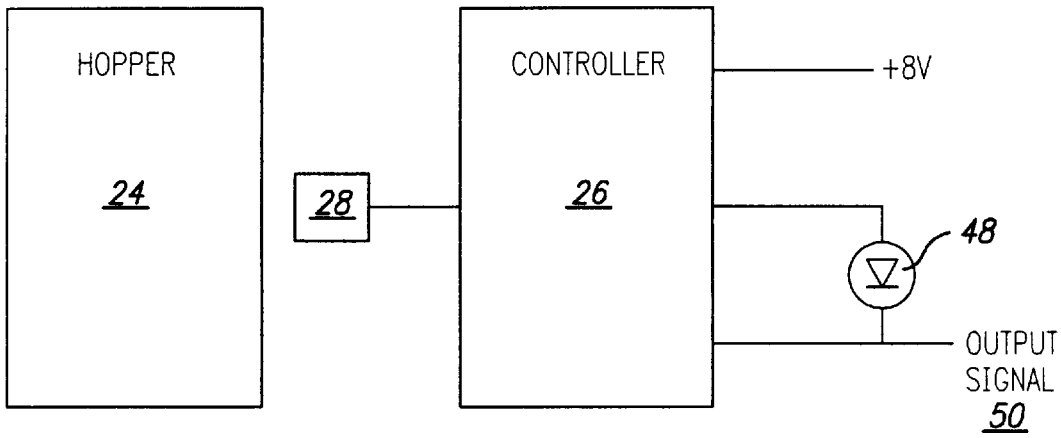
FIG. 3 is a diagrammatic view of an embodiment of a sensor assembly and controller of the beverage dispenser of FIG. 1.
Figure 4:
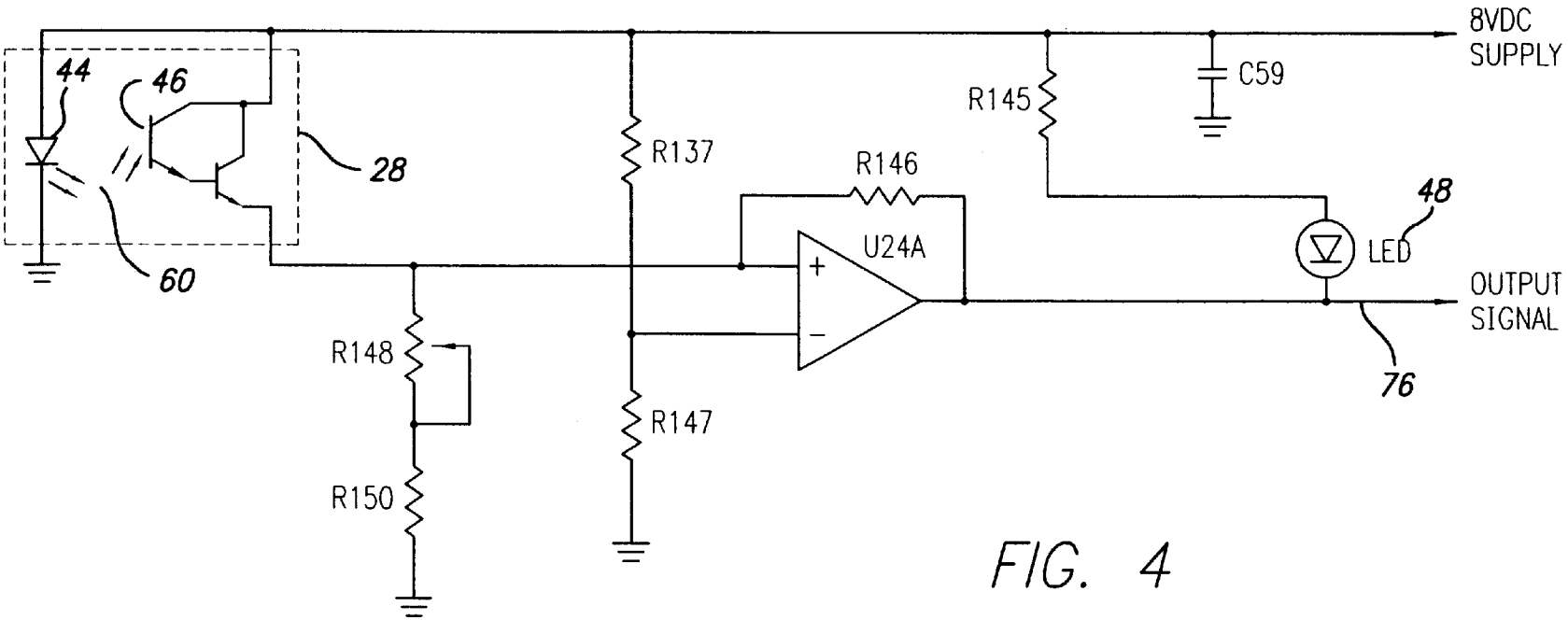
FIG. 4 is a schematic diagram of an embodiment of the circuit for the sensor assembly of FIG. 3.

Referring now to FIGS. 3 and 4, hopper level sensor assembly 28 detects the presence or absence of powder or concentrate 36 in hopper 24 using a light source 44, such as a light emitting diode or LED, and a light detector 46, such as a phototransistor. The primary advantage of the method is that here is no requirement for electrical connection or physical contact with hopper 24. Powder 36 is sensed by directing a beam of light from light source 44 at the external hopper surface and detecting light reflected from the material 36 in the hopper 24 using phototransistor 46. If powder 36 is not present, then the light passes through the hopper wall and generally is not reflected back onto phototransistor 46.

Sensor assembly 28 transmits a signal to controller 26 in relation to the amount of light received. Controller 26 receives an 8 VDC supply voltage and provides an output as power to an indicator light 48 and an output signal 50 to control the operation of indicator light 48 and other devices within dispenser 20, such as restricting, ceasing, locking out or otherwise controlling operation of auger motor 40 and solenoid valve 30 when the level of powder 36 in hopper 24 is below a desired level or otherwise not detected.

One embodiment of sensor assembly 28 and associated circuit of controller 26 is shown in FIG. 4. Sensor assembly 28 is a light emitter-detector pair 44, 46 that is mounted proximate to the hopper, generally in close proximity to one another, typically around 0.35 inches. Resistor R148 within controller 26 is adjusted with no powder present to produce approximately 0.3 volts at pin 3 of comparator U24A. This value is less than the threshold set by the resistor pair R137, R147, so the output of comparator U24A is low and the indicator LED 48 is on. When powder is present the voltage at comparator U24A pin 3 rises significantly due to increased current output caused by more light falling on phototransistor 46. When this voltage rises, the output at pin 1 of comparator U24A increases to the point at which indicator LED 48 turns off. Output signal 50 is available to other devices within beverage dispenser 20, such as solenoid valve 30, motor 40, and transmitter 52.

Figure 5:
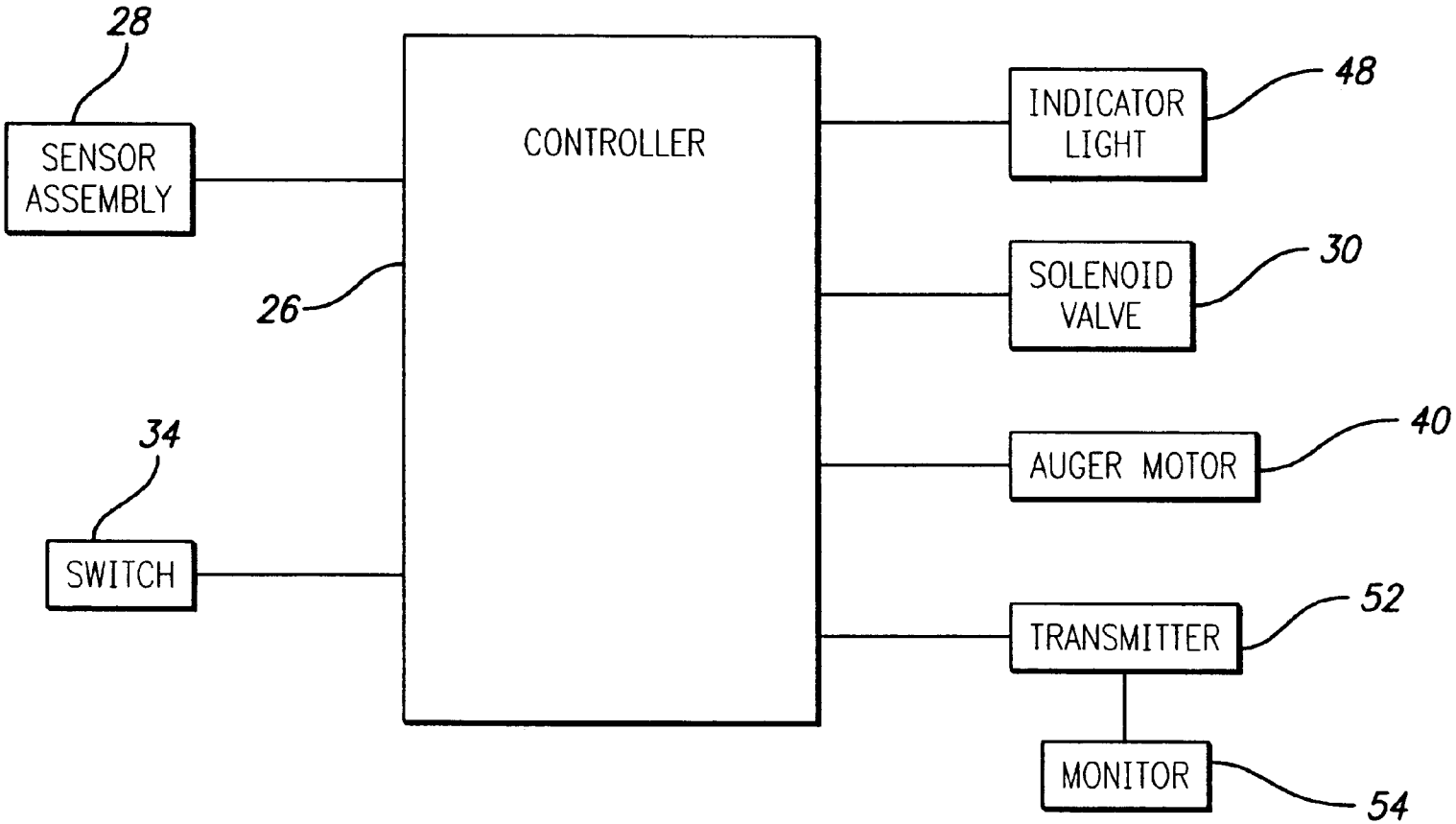
FIG. 5 is a diagrammatic view of the inputs and outputs of one embodiment of the controller.

Referring now to FIG. 5, controller 26 is powered by an 8 VDC supply and receives inputs from sensor assembly 28 and switch 34. Controller 26 can provide outputs to indicator light 48, solenoid valve 30, auger motor 40, and transmitter 52. The outputs to solenoid valve 30 and motor 40 allow controller 26 to restrict, cease, or otherwise control the dispensing of a beverage if the material or concentrate level in the hopper is below the desired level. Indicator light 48 can be supplemented with or replaced by an auditory alarm. Auger 38 and motor 40 could be replaced by other devices to deliver the powder or by other appropriate devices to deliver liquid concentrate, granular material, freeze dried concentrate or beverage, or other suitable forms of concentrate. Transmitter 52 may transmit to monitor 54 using any of a number of wired or wireless communication or transmission systems and methods, including but not limited to conductive wire, optical fiber, RF, infra red, sonic or other such systems and methods.

Figure 6:
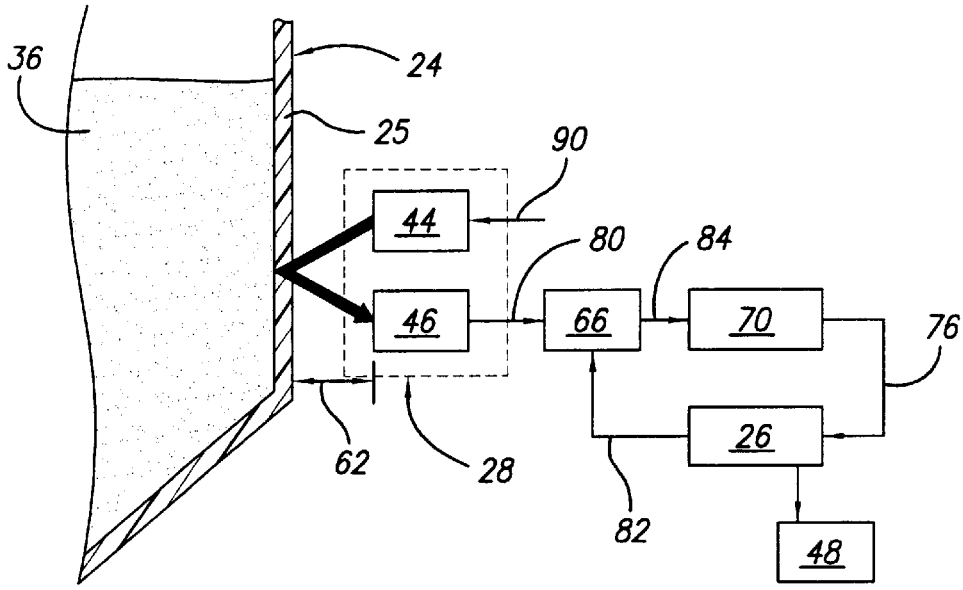
FIG. 6 is a diagrammatic view of an embodiment of a portion of a beverage dispenser hopper and the associated sensor assembly for detecting the level of the material in the hopper.
Figure 7:
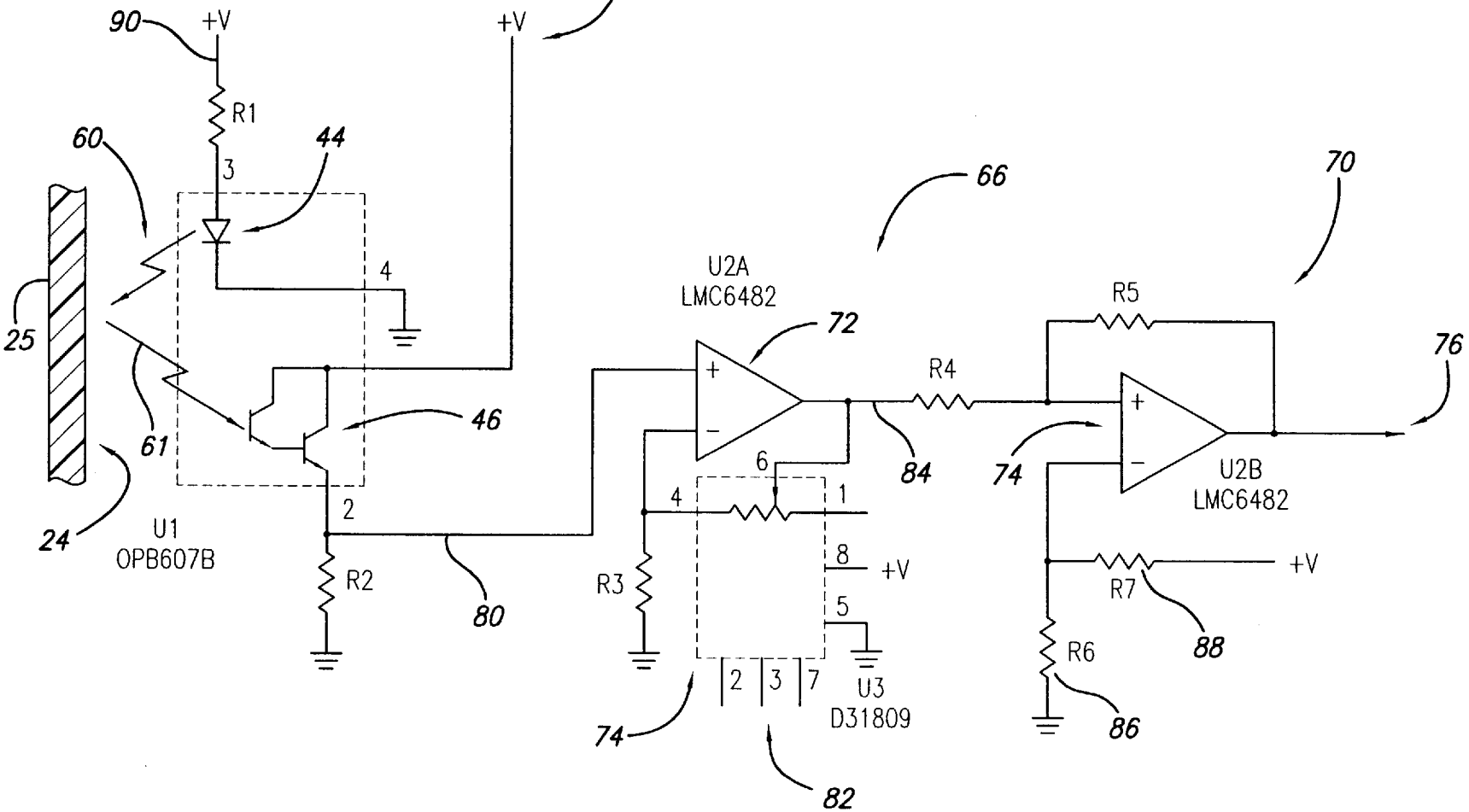
FIG. 7 is a schematic diagram of the circuit for the sensor assembly of FIG. 6 which includes a light source and detector, variable gain amplifier, and threshold comparator.

Another embodiment of the disclosed apparatus, system and method is provided in FIGS. 6 and 7. As shown in FIG. 6, the level sensor assembly 28 is positioned proximate to, yet generally separated a dimension 62 from the hopper 24 containing the material 36. The sensor assembly 28 may be of the kind which is produced by Optek Technology, Inc. of Carrollton, Tex., for example, the type OPB607B reflective object sensor, produced by Optek Technology, Inc., the materials for which are incorporated by reference. Such a sensor includes an infra red emitting diode 44 and a detector which is an NPN silicon photodarlington 46 mounted side-by-side to the infra red emitting diode. The light detector 46 responds to radiation or light from the source 44 when a reflective object is positioned within the field of the beam 60.

With reference to FIG. 7, the dispenser assembly 28 provides an output signal to variable gain amplifier 66 which in turn is coupled to a threshold comparator 70. The variable gain amplifier includes an output operational amplifier such as is produced by National Semiconductor Corporation, for example, the LMC6482 CMOS dual rail-to-rail input and output operational amplifier. Such an op amp 72 is coupled to a microprocessor such as produced by Dallas Semiconductor Corporation, including the DS1809 Dalastat non-volatile digitally controlled potentiometer 74, the materials for which are incorporated by reference. The threshold comparator 70 includes an op amp which is used in the variable gain amplifier 66.

The circuit as shown diagrammatically in FIG. 7 provides an output 76 to the controller 26.

With reference to FIGS. 6 and 7, in use, the sensor assembly 28 operates by the source 44 emitting radiation or light 60 which is detected by the detector 46. A signal 80 is communicated to the variable gain amplifier 66. As noted above, the variable gain amplifier 66 includes the digitally controlled potentiometer 74, the value of which can be adjusted by digital signals 82 from the controller 26. An output signal 84 from the variable gain amplifier 66 is communicated to the threshold comparator 70. The threshold comparator 70 then provides the output signal 76 to the controller 26. The threshold comparator 70 includes the resistor network of which the threshold voltage is set by resistors R6 (86) and R7 (88). Additionally, the light source 44 of the assembly 28 is powered by voltage source 90.

In use, a beam 60 is directed from the source 44 to the container wall 24. A portion of the beam 60 is reflected 61 from the material 36 in the container onto the detector 46. If material 36 is present in the container 24 above the level of the source 44 and detector 46, then additional light is reflected onto the detector 46. The variable gain amplifier 66 adjusts the level of the signal 80 from the detector 46 and applies it to the threshold comparator 70. The comparator 70 output signal 76 is at one level to indicate material is present in the container 24 and at a second level to indicate absence of the material relative to the beam path 60, 61. The controller 26 interprets the level of the signal 76 to activate the indicator 48 or otherwise control the dispenser.

It should be noted that there are manufacturing tolerances and environmental considerations that impact the signal level 80 from the detector 46. Such considerations including transparency, reflectivity, surface contamination, color and thickness of the hopper 24 material 25; reflectivity of the material 36 being sensed; separation distance 62 between the source 44, detector 46 and container 24; output intensity from the source 44; and sensitivity of the detector 46.

To compensate for these conditions or factors, a method of adjustment has been developed. First, an empty container 24 is positioned in the machine 20 relative to the dispenser assembly 28. The controller 26 is operated to place the controller in a "calibration mode". The controller 26 adjusts the amplifier 72 gain up or down to find the threshold at which the comparator changes state. It should be noted that the controller 26 could also adjust the threshold or adjust both the threshold and the gain to allow for very wide variations in the factors noted above. The gain is then adjusted a pre-determined amount past the threshold in the direction to indicate no material is present. This adjustment prevents small momentary variations in signal level from causing false toggling of the indictor device. The controller is then switched out of the calibration mode and the setting are retained.

A method of operating a beverage dispenser using a hopper level sensor includes sensing the level of the concentrate in a hopper, providing an indication of a level of concentrate in the hopper, and restricting delivery of a beverage when the level of concentrate is beyond or outside of a defined parameter or range of parameters such as when the level is low. The sensor operates on a reflected signal infrared sensor. The sensor is positioned toward an available surface of the hopper such as a rear wall as shown herein, so that multiple sensors can be used in a multiple hopper machine. The delivery of a beverage may be restricted, ceased or otherwise controlled by controlling the flow of water or concentrate into the mixing apparatus 32.

The reflected signal or beam path 60 is established in a filled or full hopper condition such that the reflection, regardless of the hopper material, is generally consistent when the powder or other concentrate 36 is in the hopper 24. When the powder or concentrate 36 drops to a level where it is no longer sensed, the sensor signal changes thereby indicating that the powder is below the desired level. The sensor 28 also will indicate a low level for a "hopper missing" situation in which the hopper 24 is removed from the machine 20.

As indicated above, when the sensor assembly 28 indicates the powder 36 has dropped to a sufficiently low level, it will transmit a signal 76 to the controller 26. The signal 76 received by the controller 26 can be used to activate an indicator light 48 or other indicia such as an auditory signal. Also, the controller 26 can send a signal to a transmitter 52 which can transmit the information by RF or other communication means to a monitor 54.

A low level hopper condition can also be used by the controller 26 to lock out operation of the solenoid valve 30 and/or the motor 40. When a low level is detected the indicator light 48 will be activated and the motor 40 and solenoid valve 30 will be deactivated. This prevents continued dispensing from the apparatus 20 when the powder level is insufficient to produce a quality beverage product.

The locking out of the solenoid valve 30 and motor 40 takes on added importance in a frozen beverage dispenser. The powder refill system should be locked out in such a system otherwise the resultant beverage dispensed could include a high concentration of water. If the resultant beverage being added to the frozen dispenser has a high concentration of water the freeze temperature of the resultant beverage will change, typically raising the freeze temperature. An increase in the freeze temperature could cause the beverage in the machine to freeze instead of being in a semi-frozen or slush condition which would interfere with the operation of the machine or damage the machine.

Even though a powder is the type of concentrate mainly discussed above, the present disclosure is applicable to use with a liquid concentrate, freeze dried concentrate or beverage, or other suitable concentrates in the hopper or an appropriate container dispenser for the corresponding material.

While this disclosure has been described as having an exemplary embodiment, this application is intended to cover any variations, uses, or adaptations using its general principles. It is envisioned that those skilled in the art may devise various modifications and equivalents without departing from the spirit and scope of the disclosure as recited in the following claims. Further, this application is intended to cover such departures from the present disclosure as come within the known or customary practice within the art to which it pertains.

What is claimed:

1. An apparatus for use in detecting a level of material in a beverage dispenser, the beverage dispenser having a food concentrate hopper formed of material which is at least partially transparent, the apparatus comprising:

a controller for controlling operation of at least a portion of a beverage dispenser;

a sensor assembly including a light source and a light detector;

the light source and light detector being in close proximity to one another, the detector detecting a beam emitted from the source when the beam is reflected;

the sensor assembly positioned on an exterior of the hopper in proximity to the external surface of a hopper for transmitting a beam into a wall of a hopper and receiving a signal through the wall;

a comparator coupled to the sensor assembly for receiving a signal from the detector; and output from the comparator coupled to the controller for controlling operation of the beverage dispenser.

2. The apparatus of claim 1 further comprising a variable gain amplifier coupled to the detector for receiving an output signal from the detector, the variable gain amplifier coupled to the comparator to provide an input signal to the comparator.

3. The apparatus of claim 2 further comprising an output from the comparator coupled to the controller and a gain output of the controller coupled to the variable gain amplifier to provide gain adjustment of the variable gain amplifier.

4. The apparatus of claim 1, further comprising the level sensor assembly positioned at a desired level, the desired level being substantially less than a height of the hopper.

5. The apparatus of claim 4, further comprising the desired level being at a low level height.

6. The apparatus of claim 1, further comprising the exterior surface being a rear exterior surface of the hopper.

7. The apparatus of claim 1, further comprising an indicator for indicating a low level condition, the indicator being connected to and controllably operated by the controller.

8. The apparatus of claim 7, further comprising the indicator being a visual indicator.

9. The apparatus of claim 7, further comprising the indicator being an audible indicator.

10. A beverage dispenser including an apparatus for detecting a level of material in a container removably retained in the beverage dispenser, the container formed of a generally transparent material, the container retaining a volume of beverage material, a controller being coupled to the beverage dispenser to control operation of the beverage dispenser in response to a level of material retained in the container detected by the level detection apparatus, the apparatus comprising:

a sensor assembly including a light source and a light detector;

the light source and light detector being in close proximity to one another and to the container, the detector detecting a beam emitted from the source when the beam is reflected from material in the container;

the sensor assembly positioned on the container proximate to the external surface of the container for transmitting a beam into a wall and receiving a signal through the wall;

a comparator coupled to the sensor assembly for receiving a signal; and output from the comparator coupled to the controller for controlling operation of the beverage dispenser.

11. The beverage dispenser of claim 10 further comprising:

a variable gain amplifier coupled to the detector for receiving an output signal from the detector, the variable gain amplifier coupled to the comparator to provide an input signal to the comparator.

12. The beverage dispenser of claim 11 further comprising:

an output from the comparator coupled to the controller and a gain output of the controller coupled to the variable gain amplifier to provide gain adjustment of the variable gain amplifier.

13. The beverage dispenser of claim 10, further comprising:

a volume of beverage preparation material retained in the container; and mixing apparatus for mixing the beverage preparation material with water for dispensing a beverage from the dispenser.

14. The beverage dispenser of claim 13, further comprising:

the controller operatively connected to the mixing apparatus for controllably mixing beverage preparation material to control the production of beverage in response to a level of material retained in the container detected by the level detection apparatus.

15. A method for detecting a level of material contained in a beverage dispenser, the material comprising a substance for mixing with liquid to form a beverage, the method comprising the steps of;

providing a material container for holding a volume of material, at least a portion of the container being at least partially transparent;

providing a sensor assembly, the sensor assembly providing a light source and detecting a light reflected by the material in the container;

positioning the sensor proximate to the at least partially transparent portion of container;

producing a signal from a light source of the sensor assembly through the at least partially transparent portion of the container;

dispensing material from the container; and detecting a change in the reflected signal.

16. The method as set forth in claim 15 further comprising the steps of:

providing a controller coupled to the beverage dispenser;

receiving at the controller a signal from the sensor assembly; and controlling operation of the beverage dispenser in response to the signal detected by the sensor assembly.

17. The method as set forth in claim 16 further comprising the steps of:

providing a variable gain amplifier coupled to the sensor assembly;

providing a threshold comparator coupled to the variable gain amplifier and the controller;

connecting the output from the sensor assembly to the variable gain amplifier;

connecting the output from the variable gain amplifier to the threshold comparator; and connecting the output from the threshold comparator to the controller.

18. The method as set forth in claim 17 further comprising the steps of:

providing a gain adjustment signal from the controller to the variable gain amplifier to calibrate the controller.

19. The method of claim 16, further comprising the step of, in response to receiving a low-level hopper condition from the sensor assembly, having the controller lock out operation of the beverage dispenser.

20. The method of claim 19, further comprising having the controller lock out operation of the beverage dispenser by locking out at least one of a solenoid valve in the beverage dispenser and a motor in the beverage dispenser.

21. A system in combination with a beverage dispenser for detecting material in a container associated with the beverage dispenser, the system comprising:

the container being formed of a generally transparent material;

a sensor assembly including a transmitter and a detector, the transmitter producing a beam directed toward the container, the detector receiving a reflection of the beam from material retained in the container;

the sensor assembly positioned on an exterior of the container proximate to the external surface of the container for transmitting a beam into the wall and receiving a signal through the wall;

a controller coupled to the sensor assembly and producing a control signal in response to the sensor assembly; and an apparatus for producing a beverage communicating with the container for receiving material from the container and controllably dispensing a beverage therefrom in response to control signal from the controller.

22. The system of claim 21 further comprising:

a variable gain amplifier coupled to the detector for receiving an output signal from the detector, the variable gain amplifier coupled to the comparator to provide an input signal to the comparator.

23. The system of claim 22 further comprising:

an output from the comparator coupled to the controller and a gain output of the controller coupled to the variable gain amplifier to provide gain adjustment of the variable gain amplifier.

24. The system of claim 21, further comprising:

a volume of beverage preparation material retained in the container; and mixing apparatus for mixing the beverage preparation material with water for dispensing a beverage from the dispenser.

25. The system of claim 24, further comprising:

the controller operatively connected to the mixing apparatus for controllably mixing beverage preparation material to control the production of beverage in response to a level of material retained in the container detected by the sensor assembly.

26. A system in combination with a beverage dispenser for detecting material in a container associated with the beverage dispenser, the system comprising:

the beverage dispenser having a plurality of food concentrate hoppers formed of a generally transparent material;

each of the plurality of hoppers having a sensor assembly, each sensor assembly including a transmitter and a detector, the transmitter producing a beam directed toward the container, the detector receiving a reflection of the beam from material retained in the container;

each sensor assembly positioned on an exterior of the hopper in close proximity to the external surface of the hopper for transmitting a beam into the wall and receiving a signal through the wall;

a controller coupled to each sensor assembly and producing a control signal in response to the sensor assembly; and an apparatus for producing a beverage communicating with the container for receiving material from the container and controllably dispensing a beverage therefrom in response to control signal from the controller.

27. The system of claim 26, further comprising the exterior surface being the rear exterior surface of the hopper.

28. The system of claim 27, further comprising the plurality of hoppers being positioned so the sensor assemblies are not in between any two of the plurality of hoppers.

* * * * *